US007574967B2

(12) United States Patent
Smith

(10) Patent No.: US 7,574,967 B2
(45) Date of Patent: Aug. 18, 2009

(54) SECURITY CONTAINER

(75) Inventor: James M. Smith, Angus (GB)

(73) Assignee: NCR Corporation, Dayton, OH (US)

( * ) Notice: Subject to any disclaimer, the term of this patent is extended or adjusted under 35 U.S.C. 154(b) by 6 days.

(21) Appl. No.: 12/004,357

(22) Filed: Dec. 20, 2007

(65) Prior Publication Data

US 2009/0158974 A1 Jun. 25, 2009

(51) Int. Cl.
*E05G 1/00* (2006.01)

(52) U.S. Cl. ..... 109/50; 52/4; 52/23; 109/83; 109/84; 224/42.4; 224/572

(58) Field of Classification Search ..... 109/50–52, 109/1 S, 24.1, 23, 24, 49.5, 79–87; 70/63; 248/500, 505, 680; 52/4, 23, DIG. 11; 220/23.87, 220/23.9, 23.91; 224/42.4, 557, 572; 410/97
See application file for complete search history.

(56) References Cited

U.S. PATENT DOCUMENTS 1,643,189 A * 9/1927 Urovsky ..... 190/101
1,861,935 A * 6/1932 O'Donnell ..... 248/553
3,596,418 A * 8/1971 Sedwick et al. ..... 52/79.14
3,739,731 A * 6/1973 Tabor ..... 109/49.5
4,048,926 A * 9/1977 Brush et al. ..... 109/65
4,474,116 A * 10/1984 Castenada et al. ..... 109/51
4,664,041 A * 5/1987 Wood ..... 109/51
4,667,491 A * 5/1987 Lokken et al. ..... 70/63
4,938,154 A * 7/1990 Watt ..... 109/49.5
5,235,920 A * 8/1993 Hector ..... 109/51
5,351,507 A * 10/1994 Derman ..... 70/18
5,390,787 A * 2/1995 Macasaet ..... 206/309
5,595,073 A * 1/1997 Sullivan ..... 70/18
5,624,071 A * 4/1997 Sosan ..... 232/17
5,794,463 A * 8/1998 McDaid ..... 70/18
5,870,910 A * 2/1999 Specht ..... 70/58
6,026,662 A * 2/2000 Schlipper ..... 70/18
6,547,436 B2 * 4/2003 Sutton ..... 383/18
7,305,858 B1 * 12/2007 Wu ..... 70/58
7,360,379 B1 * 4/2008 Lopez ..... 70/58
7,431,555 B2 * 10/2008 Liberman ..... 414/787
2002/0148395 A1 * 10/2002 Judge ..... 109/52
2004/0216652 A1 * 11/2004 Evertz ..... 109/49.5

* cited by examiner

*Primary Examiner*—Lloyd A Gall
(74) *Attorney, Agent, or Firm*—Michael Chan

(57) ABSTRACT

A security container is detailed which has an outer housing and an inner housing there within and a tether located between the inner housing and the outer housing. The container is arranged to be secured to a surface so as to anchor the container when in use. In particular, the base of the container contains a first pair of bolt down bosses and a second pair of bolt down bosses, through which the container is to be bolted to the surface. The tether has a loop at each of a first end and a second end thereof. The loops are each arranged to be placed over a separate boss when in use.

9 Claims, 2 Drawing Sheets

SECURITY CONTAINER

TECHNICAL FIELD

The present invention relates to a security container and in particular to a security container arranged to protect the dispenser of an Automated Teller Machine.

BACKGROUND

Automated Teller Machines (ATMs) are increasingly being subjected to attack from thieves intent on stealing the ATM in order to access the cash or other valuable media stored in the dispenser within the ATM.

However, ATMs include a very secure and heavy safe, normally a CEN safe, and are secured to the surface on which they are mounted by bolts, which makes such attacks difficult. Therefore, thieves have resorted to using 4×4 vehicles or other large vehicle such as mechanical diggers or trucks to smash the ATM containing the safe away from its mountings. The ATM is then transported to a safe location where the thieves endeavour to remove the cash from the safe.

ATM manufacturers and financial institutions operating networks of ATMs have utilized a variety of protective measures in order to thwart such attacks. These measures range from using ink staining technology, which should render the media within the dispenser worthless as a result of such an attack, to placing bollards or other structures in front of ATMs in order to prevent the ram raid attack in the first instance.

Known solutions include chain guards or ram guards, which attach to the outside of the safe. These devices require fixings or holes added to the outside of the safe and hardware then attached to the surface of the safe. This method often looks like an afterthought, which does not give customers comfort that all is being done that can possibly be done to address this issue. This also negatively affects the footprint of the product, which is an issue for many customers.

However, attacks persist and it is therefore an object of the present invention to address the problem of ram raid attacks on ATMs.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

According to an aspect of the present invention there is provided a security container having an outer housing and an inner housing there within; and a tether located between said inner housing and said outer housing.

In a preferred embodiment the tether is arranged to be secured to a surface so as to anchor the container, when in use. Preferably, the tether has a loop at each of a first end and a second end so as to be easily secured to securing bolts.

Preferably, the container has a base containing a pair of bolt down bosses, through which the container can be bolted to a surface.

In the embodiment detailed herein the loops are each arranged to be placed over a separate boss when in use.

Preferably, the tether is a wire rope, most preferably a wire formed from high tensile steel with a diameter between 10 mm and 20 mm.

In accordance with the CEN standard the space between said inner housing and said outer housing is, at least, partially filled with a security fill material. Preferably, the security fill material is concrete.

Most preferably the tether is located and is of a predetermined length such that it can not be accessed should the container be damaged during an attack.

In the embedment disclosed herein the tether is positioned from a first boss around the container to a second boss and the length of the tether is less than 10% more than the distance around the inner housing of the container from said first boss to said second boss.

Preferably, the container comprises a pair of tethers and a pair of first and second bosses.

A container in accordance with the present invention has a number of practical advantages. In particular, no rework of existing CEN safes is required in order to implement the invention. There is also no impact on product footprint, which is extremely important in rendering this a practical as opposed to a merely academic solution to this problem. This is also a low cost solution which requires no maintenance throughout the lifetime of the product.

The solution is also fully integrated with no external signs and it is therefore undetectable as everything is continued within the outer housing of the container.

BRIEF DESCRIPTION OF THE DRAWINGS

Embodiments of the invention will be described, by way of example, with reference to the following drawings, in which.

DETAILED DESCRIPTION

Embodiments of the present invention are described below by way of example only. These examples represent the best ways of putting the invention into practice that are currently known to the Applicant although they are not the only ways in which this could be achieved.

Figure 1:
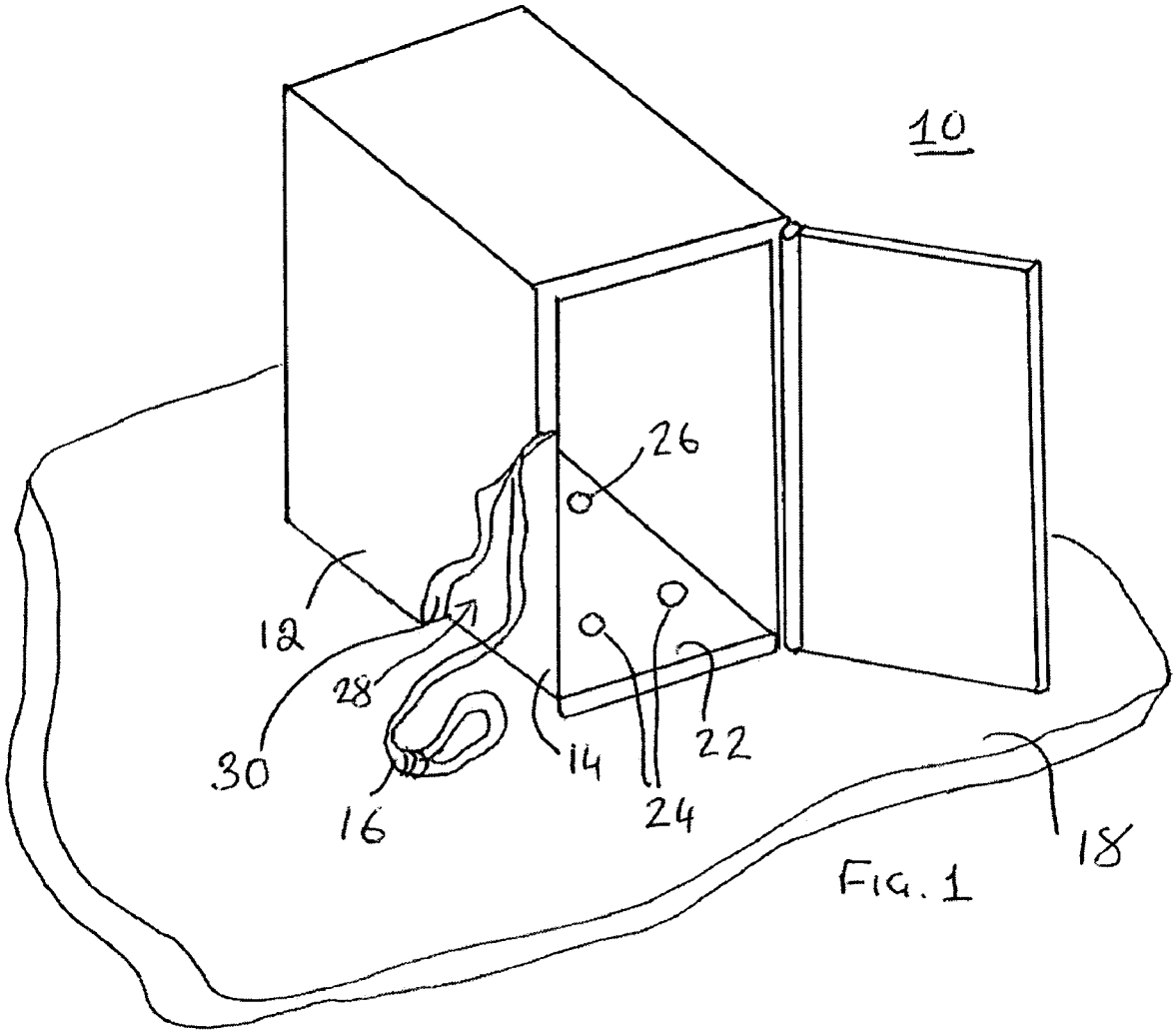
FIG. 1 is a schematic representation of a security container in accordance with the present invention located on a surface and with the outer housing partially removed.
Figure 3:
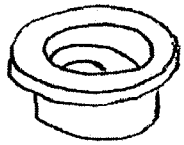
FIG. 3 is a bolt down boss for use with the container of FIG. 1 or FIG. 2.
Figure 2:
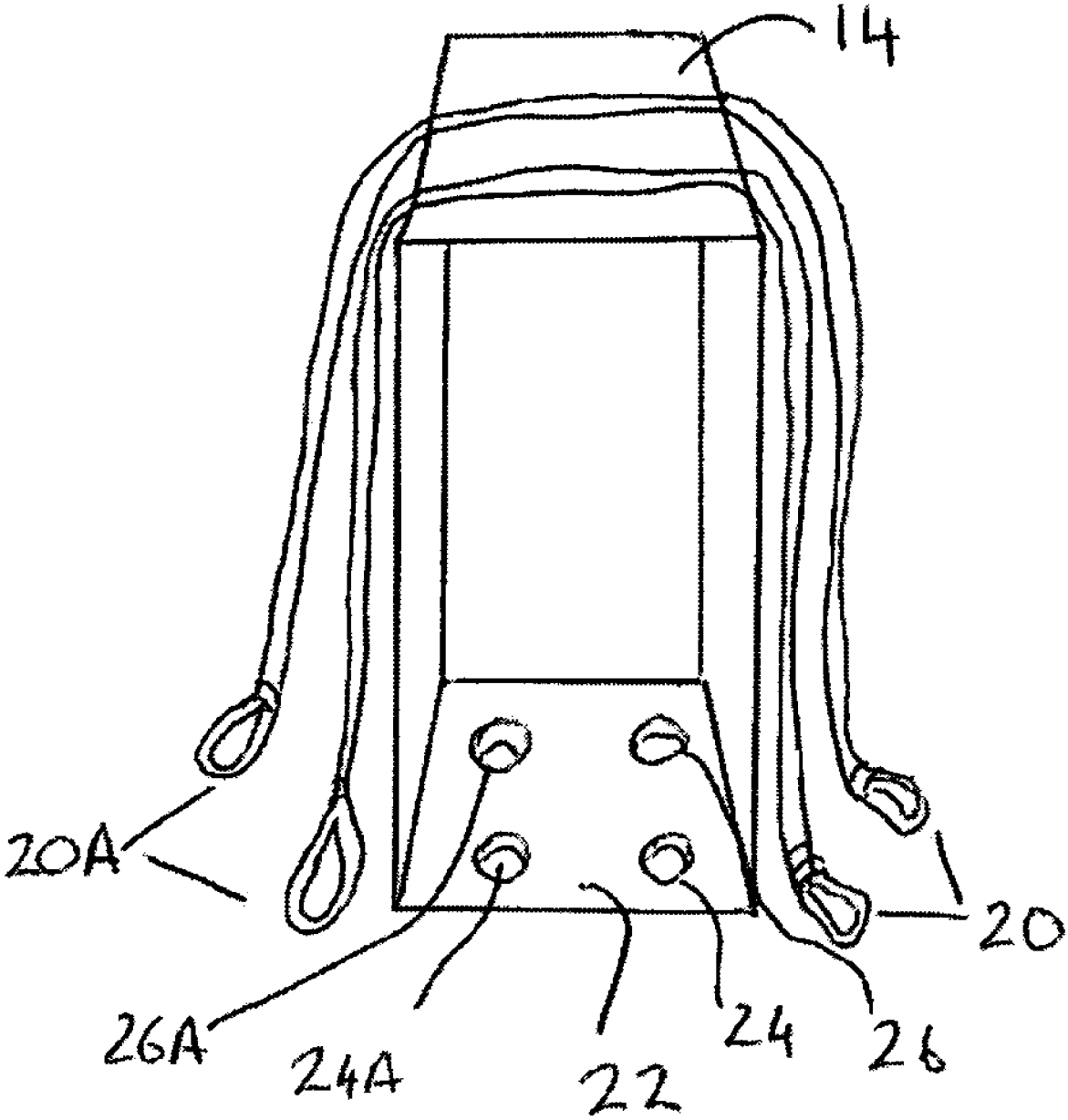
FIG. 2 is a representation of the container of FIG. 1 with the door and outer housing completely removed.

FIG. 1 illustrates a security container 10 having an outer housing 12 and an inner housing 14 there within, and a tether 16 located between said inner housing 14 and said outer housing 12. The container 10 is arranged to be secured to a surface 18 so as to anchor the container when in use. In particular the base 22 of the container 10 contains a first pair of bolt down bosses 24, 24A and a second pair of bolt down bosses 26, 26A, through which the container 10 is be bolted to the surface 18.

The tether 16 has a loop 20, 20A at each of a first end and a second end thereof. The loops 20, 20A are each arranged to be placed over a separate boss when in use. For example, the loop 20 can be placed over the boss 24 or the boss 26 and the loop 20A can be placed over the boss 24A or the boss 26A. Other arrangements may be possible. The tether 16 is a wire rope formed from high tensile steel with a diameter between 10 mm and 20 mm.

The space 28 between said inner housing 14 and said outer housing 12 is filled with a security fill material 30 in the form of concrete. It may be stated that the space 28 is only partially filled as the tether 16 will take up some volume within the space 28.

The tether 16 is located and is of a predetermined length such as it can not be accessed should the container 10 be damaged during an attack. The tether 16 is positioned from a first boss 24, 26 around the inner housing 14 of the container 10 to a second boss 24A, 26A, as detailed above, and the length of the tether 16 is less than 10% more than the distance around the container as detailed above.

In a preferred embodiment the container comprises a pair of tethers 16 and a pair of first and second bosses 24, 24A, 26, 26A.

The container is manufactured as follows. The inner housing 14 is manufactured by a standard manner compliant with the CEN standard. The inner housing contains two pairs of holes each arranged to receive a pair of bolt down bosses 24, 24A, 26, 26A. The bosses 24, 24A, 26, 26A are attached to the base 22 of the inner housing 14. A pair of tethers 16 are manufactured each with a loop at each end. A first loop of each tether 16 is placed over the first boss 24, 26 and the tether is fed over the inner housing 14 and the second loop is placed over the second boss 24A, 26A. The outer housing 12 is then manufactured and formed around the inner housing 14 so as to enclose the tethers 16 between the housings 12, 14. A gap is left so that the space 28 between the two housings 12, 14 can be filled with a security fill material in the form of concrete 30.

When in use the container 10 is mounted by locating it in the desired position on a surface 18. A bolt is then located through each of the bosses 24, 24A, 26, 26A securing both the container 10 and the tethers 16 to the surface 18.

When under attack the container is struck with considerable force, say by a 4×4 vehicle, which causes the ATM and the container 10 therein to be forced off of its secure position on the surface 18. If the force is sufficient the tethers 16 will be stretched taught and will commence to deform the inner housing 14 away from the outer housing 12. The force of the attack may be sufficient to move the container 10 slightly, by sheering the base 22 of the container 10 from the bolts and bosses. However, the thieves will not have succeeded in loosening the container 10 from its anchor to the surface 18, to which the tethers 16 still hold the container 10. As such they will not be able to remove the container 10 to a safe location to access the container 10 at their convenience.

If the length of the tethers 16 is chosen correctly they will not be accessible to the thieves, who therefore can not cut the tethers 16 in order to move the container 10.

If sufficient force is applied by the 4×4 vehicle the action of the tethers 16 may be sufficient to cause deformation of the inner housing 14. In turn this may cause the inner housing 14 to move partially away from the outer housing 12. This is in line with CEN standard requirements and does not make it any easier for the thieves to access the interior of the inner housing 14.

If the length of the tethers 16 is chosen correctly they will not only not be accessible from outside the container 10, as stated above, but they will also allow a degree of flexibility which will absorb some of the initial impact of the vehicle and makes it more difficult to break the container 10 away from its mountings. The length of the tethers 16 should be longer than the length required to reach from one boss to another, as described above but less than 10% more than that length.

Improvements may be incorporated without departing from the spirit or scope of the present invention as claimed herein.

What is claimed is:

1. A security container comprising:

an outer housing;

an inner housing disposed within the outer housing and having a base portion;

first and second bolt down bosses attached to the base portion and through which the container can be bolted to a surface; and a tether disposed between the inner housing and the outer housing and extending around the inner housing to form a substantially U-shape around the inner housing, the tether having a first end loop which is placed over the first bolt down boss and a second end loon which is placed over the second bolt down boss.

2. A container as claimed in claim 1, wherein the tether is arranged to be secured to a surface so as to anchor the container when in use.

3. A container as claimed in claim 1, wherein the tether is a wire rope.

4. A container as claimed in claim 3, wherein the wire rope is formed from high tensile steel with a diameter between 10 mm and 20 mm.

5. A container as claimed in claim 1, wherein space between the inner housing and the outer housing is, at least, partially filed with a security fill material.

6. A container as claimed in claim 5, wherein the security fill material is concrete.

7. A container as claimed in claim 1, wherein the tether is located and is of a predetermined length such that it can not be accessed should the container be damaged during an attack.

8. A container as claimed in claim 1, wherein the tether is positioned from the first bolt down boss around the container to the second bolt down boss, and the length of the tether is less than 10% more than the distance around the inner housing of the container from the first bolt down boss to second bolt down boss.

9. A container as claimed in claim 1, further comprising:

third and fourth bolt down bosses attached to the base portion and through which the container can be bolted to a surface; and another tether disposed between the inner housing and the outer housing and extending around the inner housing to form a substantially U-shape around the inner housing, the another tether having a third end loop which is placed over the third bolt down boss and a fourth end loop which is placed over the fourth bolt down boss.

* * * * *